United States Patent [19]

Parsons et al.

[11] 4,301,015

[45] Nov. 17, 1981

[54] FILTRATION

[75] Inventors: Derek A. Parsons, Cheltenham; James W. Clarke, Brockworth, both of England

[73] Assignee: Coal Industry (Patents) Limited, London, England

[21] Appl. No.: 216,638

[22] Filed: Dec. 15, 1980

Related U.S. Application Data

[63] Continuation of Ser. No. 76,852, Sep. 19, 1980, abandoned.

[30] Foreign Application Priority Data

Oct. 3, 1978 [GB] United Kingdom ..... 39100/78
Jul. 6, 1979 [GB] United Kingdom ..... 23629/79

[51] Int. Cl.[3] ..... B01D 37/02
[52] U.S. Cl. ..... 210/777; 210/193
[58] Field of Search ..... 210/777, 778, 193

[56] References Cited

U.S. PATENT DOCUMENTS 4,046,690 9/1977 Rongers ..... 210/777
4,157,305 6/1979 Muller ..... 210/777

FOREIGN PATENT DOCUMENTS 311197 4/1929 United Kingdom ..... 210/777
464337 10/1935 United Kingdom .
877983 11/1961 United Kingdom .

*Primary Examiner*—John Adee
*Attorney, Agent, or Firm*—Stevens, Davis, Miller & Mosher

[57] ABSTRACT

In the extraction of coal using a liquid solvent oil, filtration can be assisted by using a filter aid which is of coal origin. The filter aid is produced by high temperature processing of coal or an ash-rich coal-derived residue under conditions at which the ash component of the coal or residue does not fuse. A preferred starting material is filter cake from a coal extraction process.

8 Claims, 2 Drawing Figures

FILTRATION

Figure 1:
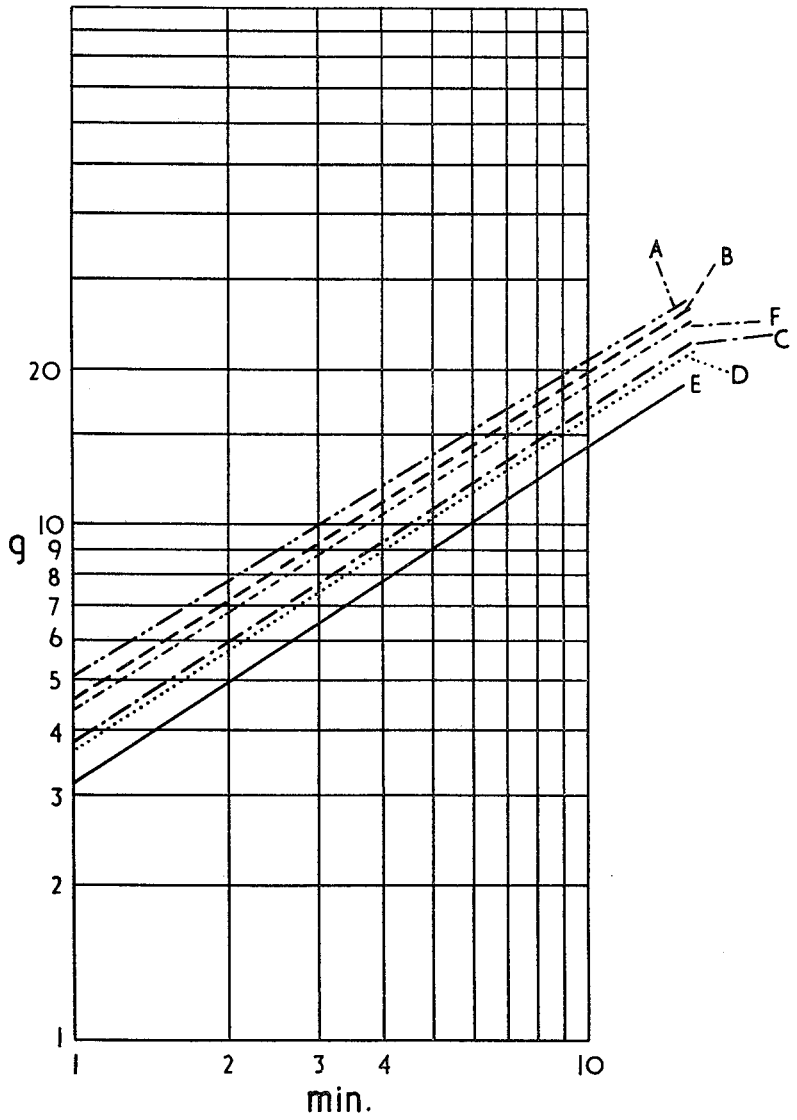

This is a Continuation of application Ser. No. 76,852 filed Sept. 19, 1980, abandoned.

This invention concerns the filtration of coal extract, and more especially concerns the use of filter aid in the improvement of filtration of coal extracted using liquid solvents.

It is well known in the art that bituminous coal can be extracted to varying degrees using a high boiling aromatic solvent. The solvent may be highly aromatic petroleum fraction or more usually an oil derived from coal, e.g. a coal tar fraction such as anthracene oil. The extract consists of coal substance in solution and solids mainly comprising mineral matter (ash) from the coal, together with a proportion of undissolved carbonaceous material. An important step in further processing is the separation of the solids and a variety of methods have been proposed or used, none of which are entirely satisfactory. The present invention is concerned with the use of filtration as a separation method. Filtration of coal extracts tends to be slow because of a number of factors including the high viscosity of filtrate, filter cakes which are at least partly compressible, and the very fine suspended particles.

It has now been discovered that conventional filter aids such as diatomaceous earth for example those marketed under the trade name "Celite" by Johns-Manville Corp., are effective when added as body aid in increasing the filter rate of coal extract and decreasing the filter cake resistivity. An important factor in the overall economics of the liquid extraction of coal is the cost of filtration and the value of the filter cake which is discarded. If the filter cake is used as a fuel, e.g. in power stations, then the addition of diatomaceous earth lowers the calorific value of the cake; in addition, the diatomaceous earth costs about 200 per tonne at 1978 prices and is discarded with the cake.

Filter aids are divided into two major types, namely body aid and precoat. A body aid is added to the suspension to be filtered, and increases the porosity of the filter cake in order to yield a more rapid filtration. A precoat is applied to a filter by deposition from suspension, before filtration of the suspension to be filtered, and acts to form a filtration medium which is a more effective filter than the filter cloth or gauze itself.

The present inventors considered the use of ground coal as a body aid but this produced small improvements only in tests. To their surprise, however, it was found that the heat treatment of coal or carbonaceous ash-rich coal-derived residue yields excellent filter aids comparable with diatomaceous earth. In particular it was found that excellent filter aids could be produced from the filter cake of a coal extraction process.

The invention therefore also provides a method of filtering coal extract resulting from the extraction of coal with a liquid solvent using a filter aid which is the product of high temperature processing of coal or an ash-rich coal derived residue under conditions at which the ash component of the coal or residue does not fuse and volatiles are removed therefrom.

The residue may be filter cake from the filtration of coal extract, which offers the possibility of an integrated coal extraction process which produces its own requirement of filter aid.

The invention, in a first embodiment, comprises the use, as body aid or as precoat filter aid, of ash produced by the combustion of coal or residue, under conditions at which the mineral matter (ash) in the coal or residue does not fuse.

A particularly preferred filter aid is that produced from filter cake, that is, the ash from burning filter cake. However, other products of combustion, for example ash from fluidised combustion of coal such as the ash separated in the cyclones cleaning the combustion gases of such a process, or ash from the combustion of residues from coal preparation plant may be used as filter aid according to the invention.

Optionally, in the case of ashing filter cake, solvent oil may be recovered by evaporation from the filter cake before the combustion of the dried filter cake under conditions at which the mineral matter in the cake does not fuse and the collection of the ash from such combustion for use as said filter aid. Before further processing, the filter cake may be extruded into pellets or otherwise pelletised. The step of solvent recovery is optional, and is intended for use in processes in which there is no efficient step of washing and drying the filter cake in the filter, that is in a process in which a substantial proportion of solvent remains in the filter cake.

Tests on the ash have shown that it is effective both as a body aid, and as a precoat. The method disclosed of producing filter aid permits the production of ash particles which are porous and of relatively large particle size (>1.00 mm), which are especially suitable as a precoat.

The combustion temperature is preferably in the region 600° to 950° C., e.g. 800° to 950° C.

The filter aid may be used as a body aid according to the invention at a concentration of 0.5–2% by weight, preferably about 1% by weight, in the suspension, and as a precoat at a concentration of 5–20%, preferably about 10% by weight, in solvent or in filtrate. Conveniently, for use as a precoat, the filter aid is mixed with suitable solvent then applied to the filter as a slurry. The slurry may contain other components, such as small quantities of asbestos fibres to give extra strength to the precoat.

The invention, in a second embodiment, comprises the use as a precoat filter aid of ash-rich coal-derived residue which has been heat treated to substantially remove volatiles and any liquid solvent present. Preferably, the coal-derived residue is filter cake from the liquid extraction of coal, although other residues, e.g. from gravity settling, centrifugal separation or the like, may be used. The liquid extraction of coal is, as has been stated, well known in the art, and may be conveniently effected using an aromatic solvent oil such as a tar oil, preferably anthracene oil, and may be in the presence or absence of hydrogen.

Preferably, when the residue is filter cake from coal extraction, the cake is extruded into pellets or is otherwise pelletised. The resulting pellets are then heat-treated, preferably at a temperature of approximately 600° C. until the solvent and any other volatiles are driven off, that is suitably for a period of 6 to 30 minutes. The heat-treated pellets are particularly useful as a precoat filter aid and will be described specifically as such hereinafter. They are crushed and/or ground to a particle size dependent upon the screen size of the filter. The particles should not be large monosize particles which would produce a precoat with large voids which would not retain the small residual particles in the extract and would result in poor filtrate clarity (a high solids content in the filtrate). Thus the precoat must contain at least a proportion of material with a size sufficient to bridge the filter screen, and, for example, suitable particle sizes are for a 200 μm woven wire mesh screen are less than 425 μm.

As has been indicated, solvent oil and other volatiles are collected from the heat-treatment. As well as the recovery of solvent, in the case of hydrogenated extracts it is envisaged that low boiling olefins which are valuable chemical feedstocks can also be collected.

Only a proportion of the total filter cake in a coal extraction process will be required as precoat filter aid. All the filter cake may be pelletised and heat-treated in the same way, the proportion required for filter aid being crushed to the appropriate size, and the remainder being gasified to produce hydrogen in manner known per se. Because of the heat-treatment, the material to be gasified is "cleaner" than most conventional feeds for gasification. That is, despite its high ash content, the yield of troublesome tar material evolved during gasification is relatively low.

Commercial precoat filter aids are available from various sources; the present invention offers a significant cost saving compared to "Celite" and "Perlite" filter aids.

It will be appreciated that the method of the invention offers the possibility of a coal extraction process self-sufficient in precoat. The method of the invention is contrary to prior views on the de-ashing of coal extracts; de-ashing is well known to be an expensive and troublesome part of a coal extraction process and the invention amounts to the recycling of ash to the upstream side of the filter. The present filter aid is usable at concentrations and in the manner described above in the description of the first embodiment.

The invention therefore also provides a method of extracting coal, comprising digesting coal in a liquid solvent oil and filtering the undissolved coal and mineral matter from the extract, wherein filter cake from the filtration steps is heat-treated to substantially remove volatiles and any liquid solvent present under conditions at which the mineral matter does not fuse, sized to an effective filter aid particle size and the product used as a filter aid in the next cycle of filter operation.

Preferably, the products used according to the invention as filter aids are sized to an effective filter aid particle size. The sizing may be carried out by screening and, if necessary, grinding or other size reduction.

Figure 2:
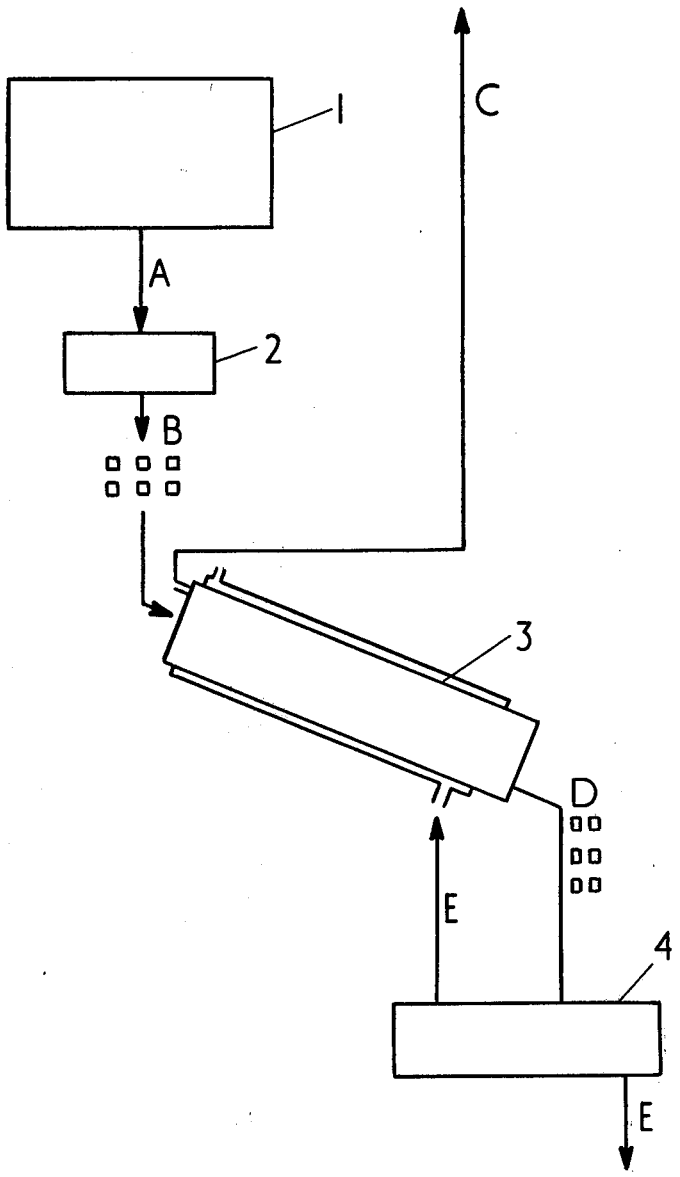

The invention will now be described by way of example and with reference to the accompanying drawings, in which FIG. 1 illustrates graphically the filtration rates of coal extract without filter aid, and with various body aids, FIG. 2 is a schematic diagram of a plant to make filter aid from coal extraction filter cake.

EXAMPLE 1

(a) A coal extract was prepared on a ½ tonne per day continuous pilot plant, by extracting a sample of Beynon coal (a prime coking coal, coal rank code [CRC] 301a in the National Coal Board's Coal Classification: "The Coal Classification System used by the National Coal Board (Revision of 1964)", published by National Coal Board Scientific Control, London) with 4 times its weight of anthracene oil, at 420° C. for a residence time of 1 hour. Accurately weighed amounts of filter aid were added to samples of the coal extract, as body aid. The mixture was well stirred, filtered at $1.38\times10^5$ Pa (20 psi) pressure through a heated (225° C.) filter and the filtration rate data recorded. The filtration temperature was kept constant for the series of tests since preliminary work had shown small but unexplained changes in cake resistivity with temperature.

(b) A series of tests to determine flow rate were carried out using test samples:

"A" 1% ash prepared from filter cake, in the coal extract. The ash was prepared by heating a sample of filter cake from filtering an extract of a mid rank coal in anthracene oil, to 950° C. in a furnace in the presence of air.

"B" 1% "Celite" 505 commercial diatomaceous earth filter aid, in coal extract.

"C" 1% Secondary ash fines recovered from the cyclone separation of a five foot (1.52 m) diameter fluidised bed coal combustor, in coal extract.

"D" 1% power station fly ash (Central Electricity Generating Board), in coal extract.

"E" Coal extract without filter aid.

"F" 1% First ash fines from the five foot fluidised coal combustor, in coal extract.

Filter cake resistivity was calculated but can be misinterpreted when filtering using body aids, so that for many practical purposes the filtration rate is more useful. The general equation for flow per unit filtering area is $$f=at^b$$

where a and b are constants, f represents total flow per unit area t represents time.

It follows that a logarithmic plot of total flow against time should produce a straight line which will serve as a rate plot. This was done for the samples "A" to "F" and is illustrated in FIG. 1, which shows total flow in g against time in mins.

(c) All the types of ash used reduced the filter cake resistivity and increased the filtration rate. The ash from filter cake and the secondary fines from the fluidised bed combustor were especially effective, the former being comparable in performance with the commercial filter aid.

The performance of body aids appears to be dependent on the particle structure and size. The CEGB fly ash is composed mainly of solid spheres and is a poor body aid when compared with the irregular open structure of the ash produced from filter cake. These structures are largely determined by the temperature at which the ash was formed; ash produced above its fusion temperature has been found to form a poor body aid.

(d) In a further test, coal from Penallta colliery (a CRC 202 high rank coal) was ground to 100%–200 μm. This coal was selected on the basis that it does not swell or soften at the filtration temperature. The addition of this ground coal to coal extract as a filter body aid reduced the filter cake resistivity whilst producing a small improvement in filtration rate. The reduction in filter cake resistivity is a result of the increased solids loading and the overall indications are that coal per se does not have the correct particle structure to function as a body aid.

EXAMPLE 2

(a) When assessing the filter aid as a precoat, the assessment is based mainly on filtrate clarity rather than on filtration rate. The precoat tests were carried out using wire mesh (100 μm and 0.4 mm) in place of the filter paper used in the body aid tests. The precoat was applied as a slurry of 10% by weight in anthracene oil immediately prior to the filtration of the extract. The filtrate was collected as aliquots and these were analysed for ash content. The filtration rate was recorded, and the results of the precoat tests are given in the table below.

| Wire mesh size precoat | Paper | 100 μm Celite 560 | 100 μm Filter aid from cake(3) | 0.4 mm Filter aid from cake(3) |
|---|---|---|---|---|
| % Conc. of residual filter aid in application solution(1) | — | 0.35 | 0.60 | 1.63 |
| % Filtrate ash (@ steady conditions)(2) | 0.06 | 0.09 | 0.08 | 0.15 |
| Filter cake resistivity m $kg^{-1} \times 10^{-11}$ | 2.3 | 3.7 | 3.2 | — |
| Filtration rate @ 10 g ($g^{min-1}$) | 2.85 | 3.0 | 3.0 | — |

Notes:
(1)Residual content of precoat in precoat solution after applying precoat (initially 10%)
(2)Neglecting first filtrate formed (nominally 20%)
(3)The filter aid is prepared from the filter cake mentioned in sample A of Ex.1, but extruded into pellets before heat treatment at 950° C.

(b) The results in the table show that the clarity of the filtrate and the filtration rate obtained with a precoat of filter aid prepared from filter cake was comparable with a "Celite" precoat. The filter aid prepared from filter cake was able to bridge gaps of up to 0.4 mm, despite the filter aid only containing particles up to 100 micron.

(c) It was found that if the filter aid is prepared from pieces of filter cake, without extrusion some large particles (>1.00 mm) remained after heat treatment and these were not destroyed by agitation. The large particles were comparable in performance as a body aid with smaller particles (<1.00 mm), which implies that the large particles must be porous in character. Such large particles are therefore indicated especially for use as precoats because of their large size and high porosity.

FIG. 2, as has been stated, illustrates a scheme for the production of filter aid from filter cake from a coal extraction process. The filter cake, stream A, is removed from the filter, 1, then passed through an extruder, 2, to yield pellets, B, to facilitate handling and solvent recovery. The pellets are passed to a reactor, 3, which is an externally heated rotary kiln, or a fluidised bed, for example operating at 400° C. The solvent is evaporated and is taken off as stream C, then condensed for re-use. The solvent-free pellets, as stream D, are then passed to a second reactor, 4, in which residual carbonaceous matter is burnt off and ash produced as stream E, which forms filter aid for the coal extraction process. The second reactor is preferably maintained at a temperature not exceeding 950° C., and an internally fired furnace, recirculating air furnace, fluidised bed or other conventional furnace is indicated. Conventional methods of temperature control are expected to be sufficient. The waste heat from the second reactor, indicated by E, is preferably used to heat the first reactor.

EXAMPLE 3

A coal extract was prepapred by digesting a high volatile, weakly caking bituminous coal (from Annesley colliery, near Nottingham, England) CRC 702 in the National Coal Board's Coal Classification: "The Coal Classification System used by the National Coal Board (Revision of 1964)", National Coal Board Scientific Control, London, with 4 times its weight of anthracene oil at 420° C. for one hour. The product, containing 0.6% mineral matter and 8.8% residual undissolved carbonaceous material, was filtered on a laboratory filter, the filter cake being extruded into pellets and heated to 500° C. for 6 minutes in an oven. The pellets were crushed and a fraction less than 425 μm was tested as a precoat. 10% by weight of the precoat was suspended in anthracene oil and passed through the laboratory filter which used a 200 μm mesh woven wire screen as a filter medium, until a layer 0.89 μm thick of precoat was formed.

An identical coal extract to that described above was passed through the filter at a temperature of 150° C. and under $1.38 \times 10^5$ pa (20 psi) pressure. Under steady state conditions, the filtrate contained less than 0.1% mineral matter, which would be acceptable on a commercial scale coal extraction plant.

Under the same experimental conditions, a precoat of "Celite" 560 containing 60% of particles >100 μm, also produced a filtrate containing less than 0.1% residual mineral matter. Without a precoat, the residual solids in the coal extract were unable to bridge the apertures in the filter screen and no solids removal took place.

We claim:

1. An improved method of filtering coal extract resulting from the extraction of coal with a liquid solvent, including the use of a filter aid, wherein the improvement comprises using as the filter aid the product of high temperature processing of filter coke from the coal extraction process to yield an effective filter aid, under conditions at which the ash component of the cake does not fuse and volatiles are removed therefrom.

2. A method as claimed in claim 1, wherein when the filter cake is processed, any liquid solvent present is evaporated and collected for reuse in the extraction of coal.

3. A method as claimed in claim 1, wherein the filter cake is pelletized before the high temperature processing.

4. A method as claimed in claim 1, wherein the product of the high temperature processing is sized to an effective particle size for a filter aid.

5. A method as claimed in claim 1, wherein the filter cake is heat treated at a temperature of approximately 600° C. for a period of 6 to 30 minutes.

6. A method as claimed in claim 1, wherein the high temperature processing is under combustion conditions at which the ash component of the cake does not fuse.

7. A method as claimed in claim 6, wherein the product filter aid is used as a body aid at a concentration of 0.5 to 2% by weight.

8. A method as claimed in claim 1, wherein the product filter aid is used as a precoat filter aid of a concentration of 5 to 20% by weight.

* * * * *